United States Patent [19]

Takatsu et al.

[11] 4,428,261

[45] Jan. 31, 1984

[54] SCREW FEED APPARATUS FOR USE WITH A POWER SCREWDRIVING TOOL

[75] Inventors: Yukihiro Takatsu; Shoichi Yamamoto; Masaru Kamioka, all of Shiga, Japan

[73] Assignee: Nisco Inc., Shiga, Japan

[21] Appl. No.: 351,463

[22] Filed: Feb. 23, 1982

[30] Foreign Application Priority Data

Feb. 23, 1981 [JP] Japan ..... 56-24867[U]
Sep. 14, 1981 [JP] Japan ..... 56-136971[U]

[51] Int. Cl.[3] ..... B25B 23/02
[52] U.S. Cl. ..... 81/434; 227/120
[58] Field of Search ..... 81/57.37, 434; 227/120

[56] References Cited

U.S. PATENT DOCUMENTS 3,930,297 1/1976 Potucek et al. ..... 81/434
4,059,034 11/1977 Hornung ..... 81/57.37
4,251,017 2/1981 Doyle et al. ..... 227/136

*Primary Examiner*—James L. Jones, Jr.
*Attorney, Agent, or Firm*—Birch, Stewart, Kolasch & Birch

[57] ABSTRACT

A screw feed apparatus for use with a power screwdriving tool comprises a casing relatively slidably mounted on an adapter detachable to the tool, a pair of brackets mounted to the forward end of the casing, a pair of feed sprockets disposed within the brackets and engageable with a magazine belt which carries a series of self-drilling screws, a ratchet wheel supported by the brackets so as to be co-rotatable with the feed sprockets, a slide member supported on the casing so as to move toward the ratchet wheel in response to forward movement of the adapter and move away from the ratchet wheel in response to rearward movement of the adapter, and a claw member operatively supported by the slide member so as to force the ratchet wheel to rotate intermittently by a regular pitch as the slide member moves away from the ratchet wheel.

5 Claims, 19 Drawing Figures

Fig.15
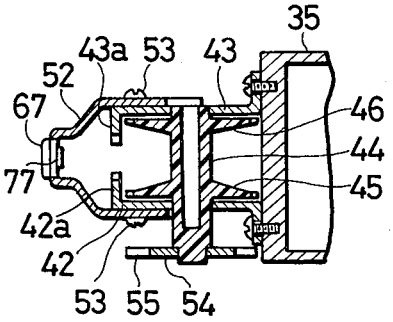
Fig.14
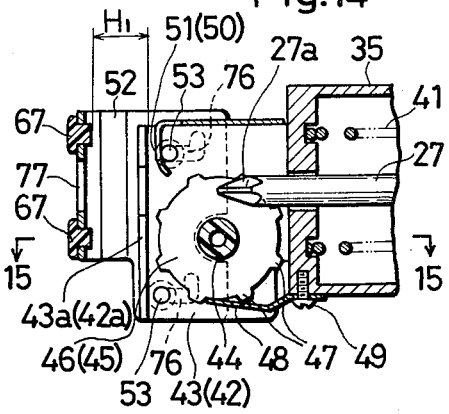
Fig.16
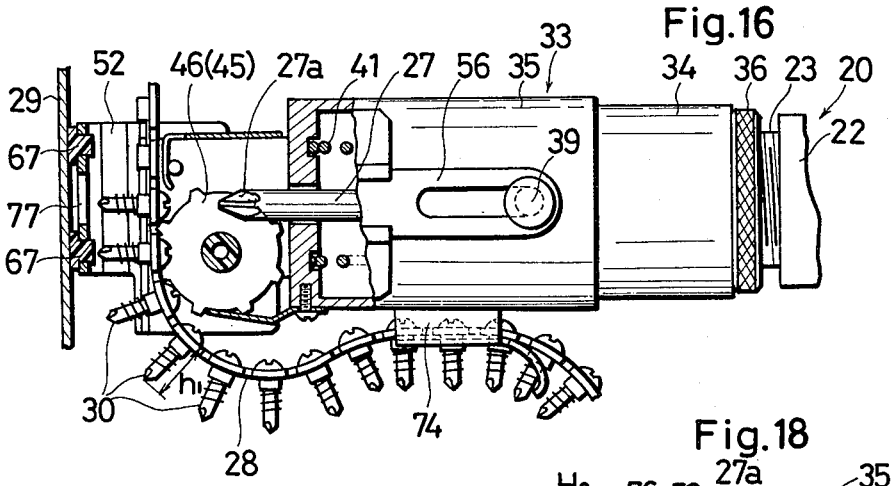
Fig.17
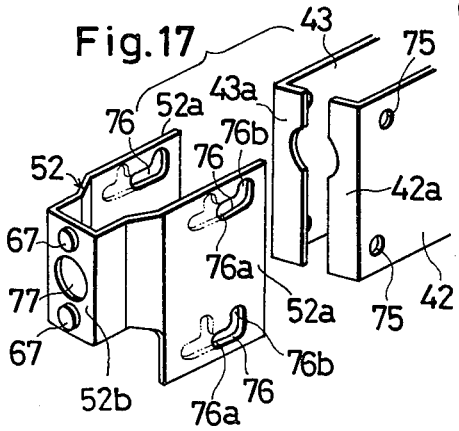
Fig.18
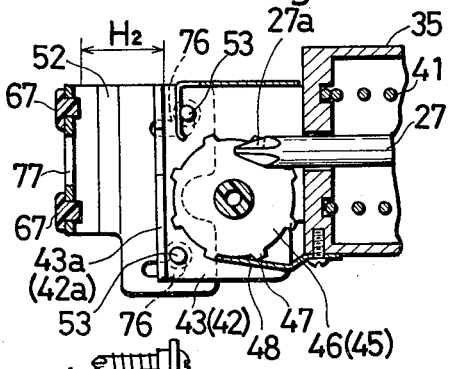
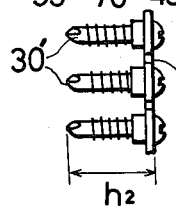
Fig.19

SCREW FEED APPARATUS FOR USE WITH A POWER SCREWDRIVING TOOL

BACKGROUND AND SUMMARY OF THE INVENTION

This invention relates to improvements in a screw feed apparatus for use with a power screwdriving tool, and more particularly to an automatic screw feed apparatus in which a series of self-drilling screws carried in line at a regular space interval by a flexible, flat magazine belt are automatically supplied one after another to a forward end section of the screwdriving tool.

A conventional screwdriving tool as disclosed in U.S. Pat. No. 4,059,034 to Hornung has proposed a screw feed mechanism comprising a pair of feed wheels having sprocket teeth arranged to engage the notches of a flexible magazine belt carrying a series of self-drilling screws to be driven into a workpiece, and ratchet mechanism for rotating the feed wheels intermittently by one pitch in response to relative sliding motion between a slide member and a casing to feed the magazine belt for the purpose of automatically supplying the self-drilling screws one after another to the forward end section of the power tool. More particularly, this prior art screw feed mechanism includes a disc which causes oneway rotation of the pair of feed wheels which are in engagement with the screw carrier belt, said disc having a pin projecting at one side thereof so as to be engaged in a guide slot of the casing which is partly inclined with respect to the longitudinal axis of the tool, so that the pin and the guide slot cooperate to rotate the disc together with the feed wheels in one direction by one pitch as the forward end of the slide member is pressed against the workpiece. However, to utilize the engagement of the pin with the inclined guide slot at the initial operative stage of one working cycle invites such a disadvantage that a greater force is initially required for pressing the forward end portion of the tool against the workpiece, causing inefficiency in driving the screws into the workpiece. This disadvantage may be eliminated by decreasing the inclined angle of the guide slot. In this case, however, another disadvantage is invited that a stroke required for driving the screws becomes longer, causing undesirable increase in the entire longitudinal length and weight of the apparatus, which, in turn, causes difficulty in manipulation and inefficiency in operation.

Further, the prior art mechanism disclosed in the U.S. patent referred to in the foregoing has a further disadvantage caused by a fixed type nose piece. As is well known, it is necessary to provide a certain distance of space between a belt guide or retainer and the front end wall of the nose piece in order to make a selected self-drilling screw properly positioned within the space prior to driving the screw into the workpiece. As a matter of fact, however, various sizes of self-drilling screws are employed in industry. Therefore, if the above-mentioned space is shorter than the entire length of the screws to be driven, the nose piece must be replaced with a larger one. On the other hand, if the above-mentioned space is excessively larger than the entire length of the screws, working efficiency is diminished because of the uselessly longer stroke in each working cycle.

Still further, the prior art mechanism disclosed in the above-referred U.S. patent has a further disadvantage that a driver member is likely to come out of a chucking member because of frictions between the driver member and the magazine belt when the driver member returns to its starting position from its operative position where the bit portion of the driver member passes through the magazine belt. Once the driver member is disengaged from the chucking member, the apparatus must be, in many cases, disassembled for re-attaching the driver member into the chucking member, which is very inconvenient.

It is, therefore, an object of the invention to eliminate the above-discussed disadvantages in the conventional apparatus.

Another object of the invention is to provide an improved screw feed apparatus which permits decrease in size and weight of the apparatus as well as efficiency in operation by diminishing a forward stroke of a screwdriving tool in each working cycle.

A further object of the invention is to provide an improved screw feed apparatus in which a pair of feed sprocket wheels are rotated by one pitch not in the course of forward stroke but in the course of rearward stroke of the screwdriving tool.

A still further object of the invention is to provide an improved screw feed apparatus which incorporates a novel, positionally adjustable nose piece to be pressed against a workpiece.

A yet further object of the invention is to provide an improved screw feed apparatus which incorporates means for preventing undesirable disengagement of a driver member from a chuck of the screwdriving tool.

Other objects, features and advantages of the invention will become more fully apparent from the detailed description given hereinafter in connection with the accompanying drawings. It should be understood, however, that the detailed description and specific examples, which indicate preferred embodiments of the invention, are given by way of illustration only, since various changes and modifications within the spirit and scope of the invention will be apparent to those skilled in the art from this detailed description.

According to the present invention, there is provided a screw feed apparatus for use with a power screwdriving tool which comprises an internally threaded adapter detachable by threads to an externally threaded shank portion of the power tool, an elongated driver member datachable at one end to a chuck formed with the shank portion, a casing relatively slidably mounted on the adapter, at least one spring disposed within the casing for urging the adapter axially outwardly, a pair of brackets mounted to a forward end of the casing and provided with guide means for guiding a flexible magazine belt in a direction transverse to a longitudinal axis of the power tool, the magazine belt carrying a series of self-drilling screws which are aligned in line and spaced at a regular pitch, a pair of feed sprocket wheels disposed within the brackets for feeding the magazine belt intermittently by the regular pitch, a nose piece mounted to a forward end of at least one of the brackets for providing a predetermined distance of screw receiving space between the forward end of the brackets and a workpiece into which the self-drilling screws are driven, a ratchet wheel supported by one of the brackets so as to co-rotate with the pair of feed sprocket wheels, a slide member supported on the casing so as to be axially slidable back and forth, the slide member being so arranged as to move toward the ratchet wheel in response to forward movement of the adapter and move away from the ratchet wheel in response to rearward movement of the adapter, and a claw means operatively supported by the slide member so as to force the ratchet wheel to rotate intermittently by the regular pitch as the slide member moves away from the ratchet wheel.

The apparatus according to the invention may preferably include means for adjusting relative positions of the nose piece to the mounting brackets and means for preventing the driver member from slipping out of the chuck.

BRIEF DESCRIPTION OF THE DRAWINGS

FIG. 14 is a sectional view taken along the line 14—14 of FIG. 10, with a nose piece positionally adjusted for shorter size screws;

FIG. 15 is a sectional view taken along the line 15—15 of FIG. 14;

FIG. 16 is an elevational view, with parts broken away, of the apparatus of FIG. 9, in which the apparatus is charged with a flexible flat magazine belt carrying a series of self-drilling screws to be driven;

FIG. 17 is an exploded perspective view illustrating a nose piece and brackets therefor;

FIG. 18 is a similar view to FIG. 14, but illustrating the nose piece positionally adjusted for longer size screws; and FIG. 19 is an elevational view showing a part of a modified magazine belt carrying the longer size screws.

DESCRIPTION OF THE PREFERRED EMBODIMENTS

Figure 1:
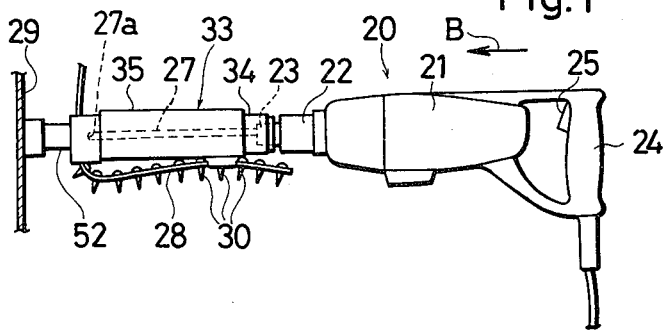
FIG. 1 is a schematic side elevation of a screw feed apparatus which is illustrated as attached to a power screwdriver in operating condition with respect to a workpiece.

Referring now to the drawings and initially to FIGS. 1 to 8, there is illustrated a screw feed apparatus 33 as the first embodiment of the present invention. As particularly shown in FIG. 1, the apparatus 33 conventionally cooperates with a known power screwdriving tool 20 such as an electric-operated screwdriver or a pneumatically operated screwdriver which includes a motor housing 22, a boss 22 with an integral, externally threaded shank portion 23 formed at one end of the housing 21, a chuck 26 arranged internally of the shank portion 23 for driving upon on-off operation of a switch 25 mounted on a handle 24 formed at the other end of the tool 20, and a driver member 27 detachably inserted into the chuck, the driver member 27 being formed at end with a known bit portion 27*a* which is so formed as to be engageable with a screw head when the screw is driven into a workpiece.

Figure 6:
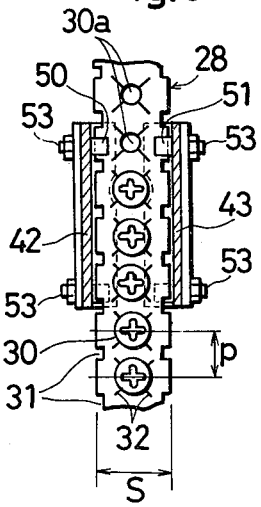
FIG. 6 is a sectional elevation taken along the line 6—6 of FIG. 4.

The apparatus 33 cooperates with a flexible flat magagine belt 28, preferably formed of synthetic resin, which carries a series of self-drilling screws 30 aligned in line at regular space interval (p) (FIG. 6) so as to be driven into a workpiece 29 one after another. Either sides of the belt 28 are formed with notches 31 each being located intermediately of any one pair of neighbouring screws 30 at the same regular space interval with that of the screws 30 as best shown in FIG. 6. A series of screw holding openings 30*a* are formed in the belt 28 at the regular space interval (p) and a plurality of slits 32 extend radially outwardly from each opening 30*a*, so that each of the screws 30 can be easily disengaged from the belt 28 through the opening 30*a* when the screw 30 is axially pushed at its head by the bit portion 27*a* of the driver member 27, conventionally.

The screw feed apparatus 33 includes a cylindrical adapter 34 which is internally threaded for engagement at 34*a*, 36 (FIG. 4) with the externally threaded shank portion 23 of the screwdriving tool 20, and a cylindrical casing 35 slidably mounted on the adapter 34. The adapter is adjustable in position on the shank portion 23 by means of a lock nut 36 which is engaged with the threaded shank portion 23. The driver member 27 extends through the casing 35.

A pair of guide slots 37, 38 are formed in opposite sides of the casing 35 so as to axially extend within a predetermined length ($L_1$). The adapter 34 has a pair of pins 39, 40 projecting oppositely and engaging in the guide slots 37, 38, respectively, so that the adapter can axially slide within the range ($L_1$) relative to the casing 35. A coil spring 41 is disposed within the casing 35 for urging the adapter 34 to move axially outwardly into the inoperative position where the pins 39, 40 are in contact with the ends 37*a*, 38*a* of the slots 37, 38 as best shown in FIG. 3.

A pair of opposed brackets 42, 43 are mounted to the forward end of the casing 35 so as to rotatably support a feed shaft 44 which extends transversely of a longitudinal axis of the driver member 27, the feed shaft 44, which may preferably be made of plastic material, for example polyacetal, being disposed in a somewhat different plane from the plane where the driver member 27 is disposed. A pair of spaced feed sprockets wheels 45, 46, which may be made of plastic material such as polyacetal, are fixedly secured to the feed shaft 44. The distance between the wheels 45, 46 corresponds to a width (S) of the magazine belt 28, and each circumference of the wheels 45, 46 is formed with teeth 47 arranged at the same regular interval or pitch as that of the notches 31 of the belt 28, so that the teeth 47 and the notches 31 are engageable and cooperate in the screw feed operation, as best shown in FIG. 6. A resilient leaf spring 48 is secured at one end to the forward end of the casing by means of a clamp screw 49 and tangentially engaged at the other forked end with the wheels 45, 46, so that the wheels can rotate in the direction of an arrow (A) (FIG. 4) but is prevented from the reverse rotation.

Figure 3:
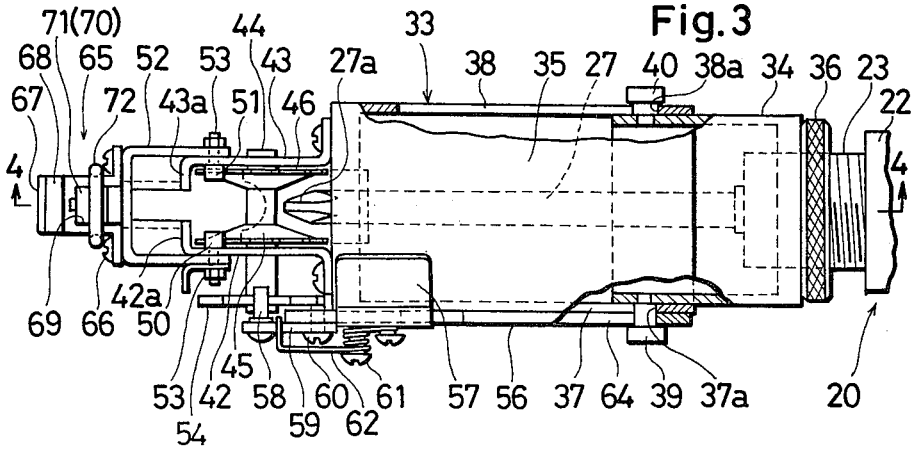
FIG. 3 is a top plan view, with parts broken away, of the apparatus of FIG. 2.

The forward ends of the brackets 42, 43 are bent oppositely to provide a pair of belt guides 42*a*, 43*a* extending transversely of the longitudinal axis of the driver shank 27, as shown in FIG. 3. In operation, the screw carrying belt 28 is inserted from one side of the brackets 42, 43 in the rotating direction of the wheels 45, 46 and guided by the inner walls of the guides 42*a*, 43*a*, with the notches 31 engaged with the teeth 47 of the wheels 45, 46. The belt 28 is disengaged from the wheels 45, 46 at outlet side by means of a pair of oppositely projecting guide pins 50, 51. The forward ends of the brackets 42, 43 are covered with a nose piece 52 which is of substantially channel-shape in cross section and fixed in position by means of four set screws 53.

Figure 2:
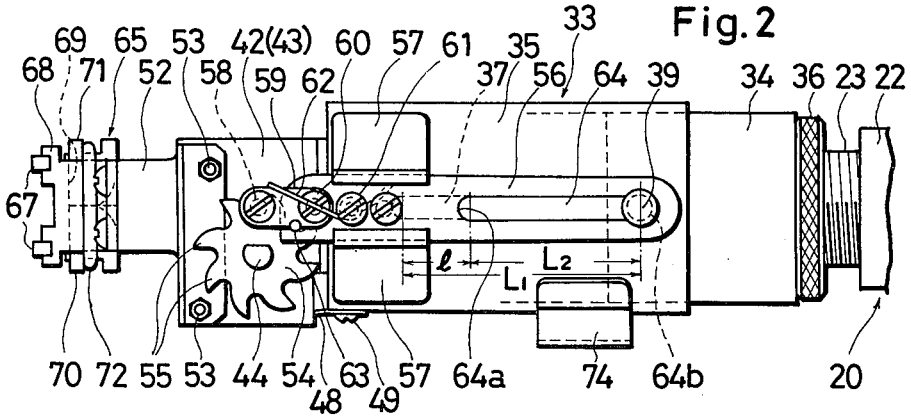
FIG. 2 is an elevational view showing the screw feed apparatus as one embodiment in accordance with the present invention.

As illustrated in FIG. 3, the feed shaft 44 extends out of the bracket 42. On this extension of the shaft 44 is mounted a ratchet wheel 54 having the same number of teeth 55 as with each of the feed sprocket wheels 45, 46. Along the guide slot 37 of the casing 35, a slide member 56 extends longitudinally of the casing 35 so as to be axially slidable and guided by a pair of opposed guide members 57 fixedly secured to the circumference of the casing 35, as best shown in FIG. 2. At the forward end of the slide member 56, there is mounted a link piece 59 which is pivoted at 60 to the slide member. The link piece 56 has a projection 58 in the form of a pin and serving as a claw extending into engagement with one of the teeth 55 of the ratchet wheel 54. The claw 58 is always retained in engagement with one of the teeth 55 by means of a torsion spring 62 which is engaged at one end with the link piece 59 and at the other end with a pin 61 so as to press the link piece against a stopper pin 63 fixed adjacent one side of the link piece on the slide member 56.

The slide member 56 has a guide slot 64 formed therein so as to extend in parallel with the guide slot 37 of the casing 35. The axial length ($L_2$) of the guide slot 64 is shorter than the axial length ($L_1$) of the slot 37 by an appropriate value (l). The guide pin 39, which is fixed to the adapter 34, is engaged with both of the slots 37, 64 in relatively slidable relation. Thus, when the adapter 34 is pushed forwardly into the casing 35 and the guide pin 39 comes into contact with one end 64*a* of the shorter slot 64, the slide member 56 is pushed to move forwardly. On the other hand, when the adapter 34 returns rearward and the pin 39 comes into contact with the other end 64*b* of the shorter slot 64, the slide member 56 is forced to return to the initial inoperative position.

Figure 4:
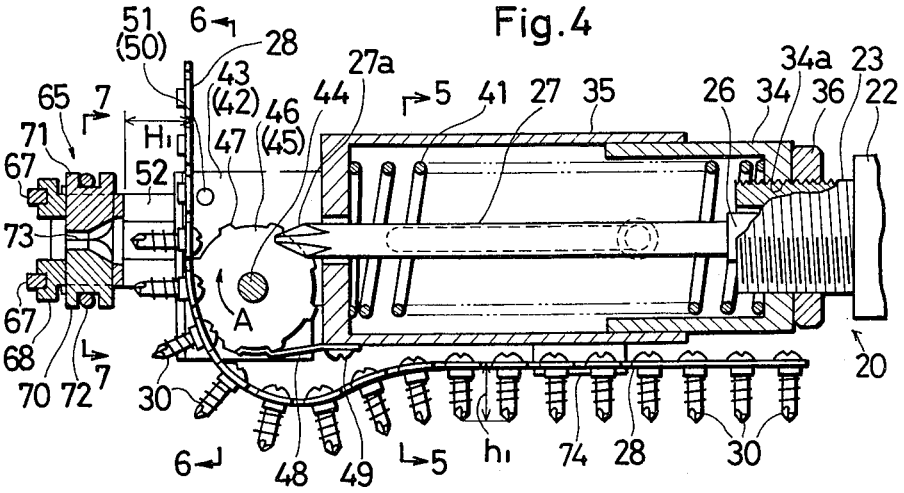
FIG. 4 is a sectional view taken along the line 4—4 of FIG. 3, in which the apparatus is charged with a flexible flat magazine belt carrying a series of self-drilling screws to be driven.
Figure 5:
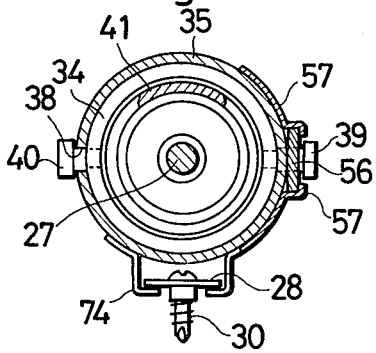
FIG. 5 is a cross section taken along the line 5—5 of FIG. 4.
Figure 7:
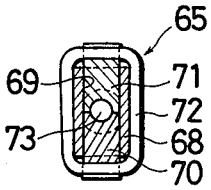
FIG. 7 is a cross section taken along the line 7—7 of FIG. 4.

The nose piece 52 is mounted to the forward end of the pair of brackets 42, 43 in order to provide a constant distance ($H_1$) of space predetermined in accordance with a shank length ($h_1$) of the screws 30 to be driven, as shown in FIG. 4. In usual operation, the nose piece 52 may be in direct contact with a workpiece 29. However, in order to assure a right angle to a workpiece 29 in operation, a screw retainer 65 may be detachably mounted to the forward end of the nose piece 52 by means of clamping screws 66.

The screw retainer 65 is illustrated as having a block 68 on the front end of which a plurality of elastic pads 67 are mounted for preventing damage to the surface of a workpiece 29. The retainer further includes a pair of opposed holder pieces 70, 71 slidably disposed within a rectangular hole 69 extending transversely of the longitudinal axis of the driver shank 27. The pair of opposed holder pieces 70, 71 are urged into contact with each other at their front ends by means of an elastic ring 72, for example a rubber ring, mounted on the block 68. The holder pieces 70, 71 are so arranged that a guide hole 73 as a path for a screw 30 can be provided therebetween, the axial center line of the path 73 being in coincidence with the longitudinal axis of the driver shank 27. Thus, when the screw 30 is pushed into the guide hole 73 by the driver member 27, the pair of opposed holder pieces 70, 71 are resiliently expanded against the elastic force of the ring 72, resulting in that the screw 30 is held in position at a right angle to the surface of a workpiece 29.

Figure 8:
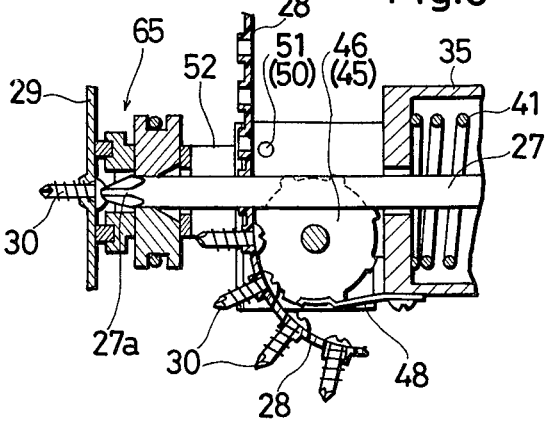
FIG. 8 is a similar view to FIG. 4, but illustrating a screwing position in which a screw has been driven into a workpiece.

In operation, the magazine belt 28 carrying a series of self-drilling screws 30 is charged with the apparatus 33, in such a manner that the belt 28 is in engagement at a front part with the feed sprocket wheels 45, 46, and at a rear part with a guide 74 so as to be held adjacent to the cylindrical surface of the casing 35, as illustrated in FIG. 4. After pressing the nose piece 52 against a workpiece 29 at a selected position, the power tool 20 is pushed in the direction of an arrow (B) (FIG. 1), so that the adapter 34 slides in the same direction within the casing 35, while the spring 41 being kept compressed until the bit portion 27*a* of the rotating driver member 27 comes into engagement with a head of one of the screws 30 held in the belt 28. By a further advancement of the adapter 34 together with the driver member 27, the bit portion 27*a* passes through the belt 28 to drive the screw 30 into the workpiece 29 as best illustrated in FIG. 8. In the course of this advancing stroke of the adapter 34, the guide pin 39, which is fixed to the adapter 34, comes into contact with the end 64*a* (FIG. 2) of the guide slot 64 and then pushes the slide piece 56 toward the ratchet wheel 54. On the other hand, in the course of the retiring stroke of the adapter 34, the pin or claw 58 of the link piece 59 comes into engagement with one of the teeth 55 of the ratchet wheel 54 so as to forcibly rotate the wheel 54 by a predetermined angular distance.

When the tool 20 is moved away in the opposite direction of the arrow (B) after completion of one working cycle for driving the screw 30 into the workpiece 29, the adapter 34 together with the driver member 27 is moved rearward by the resilient force of the spring 41 until the guide pins 39,40 come into contact with the ends 37*a*, 38*a* of the longer slots 37 as best shown in FIG. 3. On the way of this rearward movement of the adapter 34, the guide pin 39 comes into contact with the end 64*b* (FIG. 2) of the slot 64 of the slide member 56 thereby to push the member 56 back to the initial inoperative position.

As the slide member 56 moves rearward in the direction opposite to the arrow (B), the pin or claw 58 of the link piece 59, which is in engagement with one of the teeth 55 of the ratchet wheel 54, is also pulled rearward thereby to force the ratchet wheel 54 to rotate by one pitch of the teeth 55, with the result that the feed sprocket wheels 45, 46 co-rotate with the wheel 54 by the same one pitch to feed the magazine belt 28 by the same one pitch (p) (FIG. 6). In this manner, a series of the screws 30 held in the belt 28 are automatically fed one after another into the driving position lying in the longitudinal axis of the driver shaft 27.

As described above, the automatic screw feed mechanism according to the present invention is based on the back and forth rectilinear motion or stroke of the slide member 56 which causes one pitch rotation of the ratchet wheel 54 and the feed wheels 45, 46. Therefore, as being different from the feed mechanism disclosed in U.S. Pat. No. 4,059,034 wherein the feed sprocket wheel is intermittently rotated by a certain angle through the inclined engagement of a pin with a guide slot at the initial stage of each working cycle, the screw feed mechanism of the invention can provide a shorter stroke of the slide member with less load, which improves efficiency in operation and, in addition, permits a compact design of the screw feed apparatus.

FIGS. 9 thru 18 illustrate a modified embodiment according to the present invention, wherein identical reference numerals are used to indicate the same or substantially same parts or elements employed in the preceeding embodiment as described in the foregoing with reference to FIGS. 1 to 8. In this modified embodiment, there are provided means for adjusting the nose piece position as well as means for preventing the driver member from slipping off the screwdriving tool.

In FIGS. 9 thru 18, there is illustrated a screw feed apparatus 33 as having a nose piece 52 mounted to the forward end of a pair of brackets 42, 43 by means of four set screws 53. As best shown in FIG. 17, each of the brackets 42, 43 has a pair of spaced, internally threaded holes 75 formed therein each engageable with the threaded shank of the set screw 53, while each of a pair of opposed side walls **52*a* of the nose piece 52 has a pair of spaced L-shaped slots 76 formed therein each engageable with the shank of the screw 53, so that the shank of each screw 53 can extend through the slot 76 as well as the hole 75. Each of the slots 76 has one side extending in parallel with the longitudinal axis of the driver shank 27 and the other side extending transversely of the longitudinal axis. Thus, in the mounting of the nose piece 52 to the brackets 42, 43, each of the four set screws 53 can be selectively engaged with any one of the slot ends 76*a*, 76*b* (FIG. 17). The nose piece 52 has an opening 77 formed in the forward end wall 52*b*, so that a self-drilling screw 30 can pass through the opening 77 and be driven into a workpiece 29. A pair of pads 67, which are made of elastic plastic material, are mounted on the forward end wall 52*b* of the nose piece 52** for the known damage preventing purpose.

The adapter 34, which may preferably be made of synthetic resin such as polyacetal, has an internal annular flange 78 extending radially inwardly for cooperation with a stopper collar 79 on the driver member 27 for the purpose to be hereinafter described. The external diameter of the stopper collar 79 should be larger than the internal diameter of the annular flange 78. The collar 79 may be fixed in position on the driver shank 27 by means a clamp screw 80.

Figure 9:
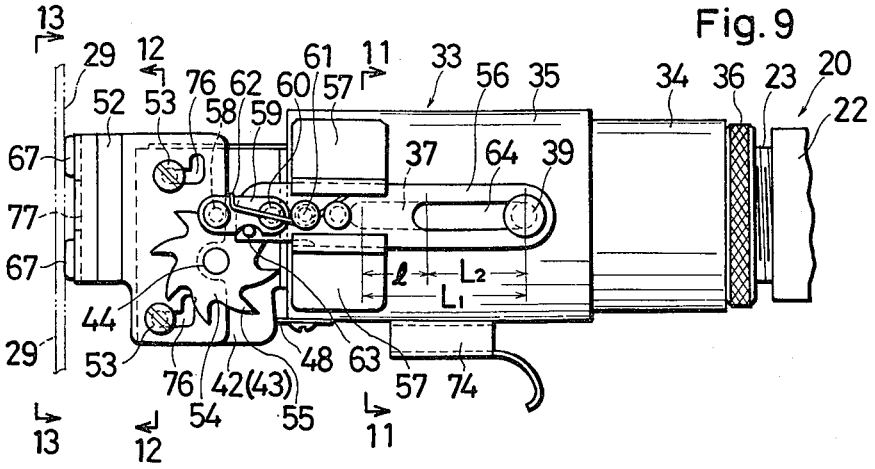
FIG. 9 is an elevational view of the apparatus as a modified embodiment according to the present invention.
Figure 10:
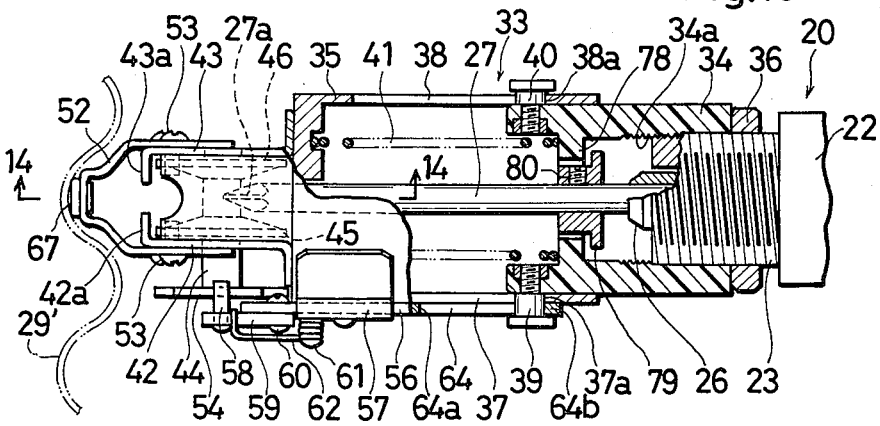
FIG. 10 is a top plan view, with parts broken away, of the apparatus of FIG. 9.
Figure 11:
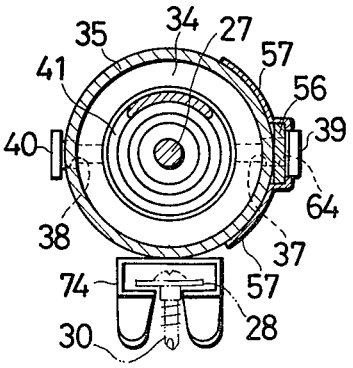
FIG. 11 is a cross section taken along the line 11—11 of FIG. 9.
Figure 12:
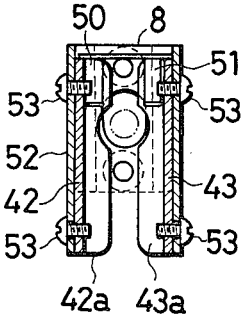
FIG. 12 is a sectional elevation taken along the line 12—12 of FIG. 9.
Figure 13:
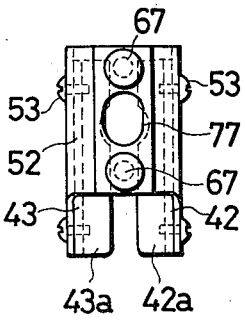
FIG. 13 is an end view of the apparatus seen in the direction of the arrows 13—13.

In a case where a magazine belt 28 carrying a series of self-drilling screws 30 each having a shank length ($h_1$) (FIG. 16) is replaced with another magazine belt 29' carrying a series of self-drilling screws 30' each having a longer shank length ($h_2$) (FIG. 19) than the screws 30 of FIG. 16, the nose piece 52 must be adjusted in position with respect to the brackets 42, 43 so as to meet the change in the shank length of the screws to be driven into the workpiece 29. For this purpose, the four set screws 53, which are in engagement at **76*a* with the four L-shaped slots 76 of the nose piece 52 as shown in FIG. 9, are loosened, and then, by manipulating the nose piece 52 to make the four set screw 53 into engagement at 76*b* with the four L-shaped slots 76, the nose piece can be extended forwardly for increasing the distance between the belt guides 42*a*, 43*a* and the workpiece 29 from the value ($H_1$) (FIG. 4) to the value ($H_2$) (FIG. 18**). As a matter of course, it is also possible to decrease the value ($H_2$) to the value ($H_1$), resulting in that an excessively long stroke in each working cycle can be avoided in case of the shorter screws with the shank length ($h_1$).

In the positional adjustment of the nose piece 52, it is unnecessary to remove the four set screws 53 from the threaded holes 75 and the L-shaped slots 76, but it is necessary to merely loosen the screws 53 slightly to the extent that the nose piece 52 can be slidably movable on the brackets 42, 43.

As will be apparent from the foregoing description, each of the set screws 53 is in engagement with the L-shaped slot 76 at **76*a* for the shorter self-drilling screws 30 each having the shank length ($h_1$), and at 76*b* for the longer self-drilling screws 30' each having the shank length ($h_2$) (FIG. 19). Thus, at either positions 76*a*, 76*b*, the nose piece 52 can be prevented from unexpectedly moving rearwardly to decrease the distance ($H_1$) or ($H_2$) between the forward end wall 52*b* of the nose piece and the guides 42*a*, 43*a*, even when the clamp screws 53** happen to become loosened to a certain extent.

It will be obvious that the L-shaped slots 76 may be formed in the brackets 42, 43 and that the slots 76 may be modified into F-shaped slots as illustrated in phantom lines in FIG. 17. It will be easily understood that the F-shaped slot has three engaging positions for fixing the nose piece 52 in accordance with three different lengths of the self-drilling screws. It will be also obvious that the number of the engaging positions of the slot can be easily increased if desired. It is further obvious that the width of the forward end wall **52*b* of the nose piece 52 may be varied in many ways and that the narrow end wall 52*b* will be suitable to a corrugated workpiece 29' as illustrated in phantom lines in FIG. 10**.

In the course of the rearward movement of the adapter 34 after the completion of one working cycle, the driver member 27 returns to the inoperative starting position from the working position where the forward end portion thereof projects through the magazine belt 28 (See FIG. 8). At this stage of the working cycle, the driver member 27 tends to be disengaged from the chuck 26 of the tool 20 because of friction developed between the belt 28 and the bit portion **27*a* of the member 27. However, according to the present invention, the stopper collar 79 is fixedly secured on the driver shank 27 so as to cooperate with the internal annular flange 78 of the adapter 34, resulting in that the disengagement of the driver member 27 from the chuck 26 can be prevented, because the driver member 27 is forcibly moved rearwardly together with the adapter 34 when the latter is moved rearwardly by the function of the spring 41. Thus, the apparatus 33 in the second embodiment according to the present invention can minimize the idle time which may otherise be caused by the undesirable disengagement of the driver member from the chuck and also provide the same advantages described hereinbefore in conjunction with the preceding embodiment as illustrated in FIGS. 1 to 8**.

The present invention being thus described, it will be obvious that same may be varied in many ways. Such variations are not to be regarded as a departure from the spirit and scope of the present invention, and all such modifications as would be obvious to one skilled in the art are intended to be included within the scope of the following claims.

We claim:

1. A screw feed apparatus for use with a power screwdriving tool, comprising an internally threaded adapter detachable by threads to an externally threaded shank portion of said tool, an elongated driver member detachable at one end to a chuck formed with said shank portion, a casing relatively slidably mounted on said adapter, at least one spring disposed within said casing, for urging said adapter axially outwardly, a pair of brackets mounted to a forward end of said casing and provided with guide means for guiding a flexible magazine belt in a direction transverse to a longitudinal axis of said tool, said magazine belt carrying a series of self-drilling screws which are aligned in line and spaced at a regular pitch, a pair of feed sprocket wheels disposed within said brackets, for feeding said magazine belt intermittently by said regular pitch, a nose piece mounted to a forward end of at least one of said brackets, for providing a predetermined distance of screw receiving space between said forward end of the brackets and a workpiece into which the self-drilling screws are driven, a ratchet wheel supported by one of said brackets so as to co-rotate with said pair of feed sprocket wheels, a slide member supported on said casing so as to be axially slidable back and forth rectilinearly, said slide member being so arranged as to move toward said ratchet wheel in response to forward movement of said adapter and move away from said ratchet wheel in response to rearward movement of said adapter, and a claw means operatively supported by said slide member so as to force the ratchet wheel to rotate intermittently by said regular pitch as said slide member moves away from said ratchet wheel.

2. The apparatus, as defined in claim 1, wherein means is provided for adjusting relative positions of said nose piece to said brackets, said means being in the form of a plurality of slots each of which includes a first groove portion extending in parallel with a longitudinal axis of said tool and at least one second groove portion extending transversely of said longitudinal axis of said tool, and each of said plurality of slots cooperates with a clamping screw whose shank section extends through one of said slots and clamps the nose piece to at least one of said brackets.

3. The apparatus, as defined in claim 2, wherein said plurality of slots are formed in said nose piece.

4. The apparatus, as defined in claim 2, wherein said plurality of slots are formed in at least one of said brackets.

5. The apparatus, as defined in claim 1, wherein said adapter has an internal flange extending radially inwardly, and said elongated driver member has a stopper collar mounted on a shank section thereof for cooperating with said internal flange.

* * * * *